United States Patent [19]

Henricson et al.

[11] Patent Number: 4,975,204

[45] Date of Patent: Dec. 4, 1990

[54] METHOD AND APPARATUS FOR THICKENING FIBER SUSPENSION

[75] Inventors: Kaj O. Henricson, Kotka; Mika P. Mäkelä, Karhula; Toivo Niskanen, Hamina; Olavi E. Pikka, Karhula; Vesa Vikman, Kymi, all of Finland

[73] Assignee: A. Ahlstrom Corporation, Noormarkku, Finland

[21] Appl. No.: 216,842

[22] Filed: Jul. 8, 1988

[30] Foreign Application Priority Data

Jul. 8, 1987 [FI] Finland ..... 873020
Nov. 4, 1987 [FI] Finland ..... 874854

[51] Int. Cl.[5] ..... B01D 29/62; B01D 33/46

[52] U.S. Cl. ..... 210/785; 210/791; 210/349; 210/383; 210/396; 210/411; 210/414; 210/415; 162/56; 162/380

[58] Field of Search ..... 210/748, 780, 785, 791, 210/804, 383, 396, 398, 402, 411, 415, 414, 435, 349; 162/56, 380

[56] References Cited

U.S. PATENT DOCUMENTS

| | | | |
|---|---|---|---|
| 1,866,970 | 7/1932 | Garland et al. | 210/411 |
| 1,932,633 | 10/1933 | Haug | 210/785 |
| 2,960,926 | 1/1960 | McKee | 100/117 |
| 3,029,951 | 4/1962 | Cannon | 210/415 |
| 3,174,622 | 3/1965 | Lamont | 210/415 |
| 3,363,759 | 1/1968 | Clarke-Pounder | 210/415 |
| 3,455,821 | 7/1969 | Aremna | 210/748 |
| 3,581,843 | 6/1971 | Rich | 210/415 |
| 3,586,172 | 6/1971 | Young | 210/415 |
| 3,680,696 | 8/1972 | Movin | 210/415 |
| 3,814,246 | 6/1974 | Wilson et al. | 210/78 |
| 3,849,302 | 11/1974 | Seifert | 210/415 |
| 4,188,286 | 2/1980 | Holz | 210/415 |
| 4,276,159 | 6/1981 | Lehman | 210/415 |
| 4,351,728 | 9/1982 | Egelhuf et al. | 210/415 |
| 4,491,501 | 1/1985 | Klein | 162/60 |
| 4,749,474 | 6/1988 | Young | 210/415 |
| 4,855,038 | 8/1989 | LeBlanc | 210/415 |

FOREIGN PATENT DOCUMENTS

| | | |
|---|---|---|
| 1102604 | 6/1981 | Canada . |
| 41712 | 9/1969 | Finland . |
| 62872 | 3/1983 | Finland . |
| 68005 | 3/1985 | Finland . |
| 54-88302 | 7/1979 | Japan . |
| 56-14792 | 4/1981 | Japan . |
| 2009274 | 6/1979 | United Kingdom . |
| 1557688 | 12/1979 | United Kingdom . |
| 2025249 | 1/1980 | United Kingdom . |

*Primary Examiner*—Richard V. Fisher
*Assistant Examiner*—Christopher Upton
*Attorney, Agent, or Firm*—Toren, McGeady & Associates

[57] ABSTRACT

The present invention relates to a method and apparatus for the continuous discharge of water from suspension, especially from fibrous pulp, whereby pulp is caused to thicken without having the water to be removed through a thick uncontrollably gathered fiber mat.

In accordance with the invention the suspension to be thickened is fed into a filtering chamber, the suspension is formed as a layer that is continuously being mixed for equalizing the consistency differences, the liquid is continuously removed from the suspension and the thickness of the fiber mat being formed on the filter surface is controlled by subjecting said mat to shear stresses.

The above described method is realized by an apparatus, in which at least one of the co-operating surfaces, the filtering surface (8) and its counter surface (10), is provided with means (12) for non-mechanically limiting the thickness of a fiber mat on the filtering surface, whereby a uncontrolled formation of a fiber mat on the filtering surface (8) is prevented.

25 Claims, 5 Drawing Sheets

METHOD AND APPARATUS FOR THICKENING FIBER SUSPENSION

BACKGROUND OF THE INVENTION

The present invention relates to a method and apparatus for the continuous discharge of water from a suspension, especially from fibrous pulp, whereby pulp is thickened without the water being filtered through a thick, uncontrollably gathered fiber mat.

In the pulp and paper industry there are processes which are carried out with a low consistency of pulp, even under 1%. Such processes are, for example, normal and reverse vortex cleaning. Subsequent to the vortex cleaning the pulp is led to a processing stage, i.e. for example, to a thickener or a head box of a paper or drying machine In any case, thickening always follows the vortex cleaning in the process.

The treatment of fibrous material, especially cellulose and wood fiber material often takes place, as mentioned above, in a low consistency suspension. For example, screening with perforated or slotted screens is carried out with a consistency of 1 to 3%. Subsequent to the screening the fibrous material is thickened to a higher consistency for several reasons. Often the consistency is raised to the range of 10 to 15%, for example, for storage or bleaching.

Thickening is carried out according to modern techniques by means of different types of disc or drum thickeners and curved filters. In conventional drum and disc thickeners the discharge of liquid, in other words thickening, is based on so called "gravity deckers", vacuum filters or pressure filters.

With gravity deckers the thickening is carried out by means of a horizontally mounted drum made of perforated plate covered with wire cloth. The pressure difference required for the thickening results from the level difference between the pulp in the inlet tower and the pulp in the filtrate chamber. Pulp may be filtered either from the inside of the drum to the outside or from the outside to the inside, which latter direction is the most usual. In practice the diameter of the drum may be 4 m, of which, for example 60% is underwater. The maximum pressure difference is thus about 20 kPa. The pressure difference at the bottom dead center is zero, of which the difference increases to its maximum value towards the surface of the inlet tower. This results in that no thickening takes place on either side close to the bottom dead center. The situation is similar in the part of the drum which is not underwater. A considerable part of the drum surfaces of the gravity deckers is inefficiently utilized. The capacity of the part of the drum in efficient use also varies according to the pressure difference, which prevails relative to the filtering surface. The specific thickening capacity of gravity deckers varies according to the pulp and the running conditions, but is typically 400–700 $l/M^2/min$. Such types of thickeners are used to prethicken low consistency pulp, for example, from 0.5% to 1,5–5%.

The filtering surface of the drum is kept clean or open to the flow by moving the surface against the filtrate or by using air to clean it. For example, a mill producing 500 tons of 90% consistency pulp requires a filter with a diameter of 4 m and length of 7 m, the surface area being about 88 $m^2$ of wire surface, to thicken the pulp from 0,5% to 1,5%.

The thickening method using a curved filter is based on gravity decker filtering. The suspension to be thickened is pumped onto an inclined filtering surface. The thickening capacity is in practice 3 to 5% and the specific capacity of liquid discharge is about the same as that of the drum filters. It has the advantage of not having any mechanically moving members, but it also has the drawback of the apparatus being very easy to clog, because arranging for efficient cleaning is difficult. Curved filter type thickeners are used in the pulp and paper industry, when minor thickening and low pulp capacities are concerned.

The above described conventional pulp thickening apparatuses or "thickeners" are characterized in that the thickening is carried out using very small pressure differences in more or less open equipment and only part of the filtering surface is utilized.

The small pressure difference and the partial use of the filtering surface result in a poor ability to discharge liquid. The open construction and operational principle result in the pulp and the filtrate possibly including air. Air in the pulp weakens, as is known, the infiltration qualities of the pulp decisively.

Of other arrangements applied in the prior art, different types of vacuum filters are used most frequently. The consistency of pulp in these filters is caused to increase by removing water from the pulp through a filter surface, for example, through a wire cloth covered by a thick fiber mat In thickening pulp it is possible, by means of the suction effect on the pulp, to use a maximum pressure difference of about 0,5 bar, because a stronger vacuum would make the filtrate boil, which is undesirable.

The pressure difference required for filtering in vacuum thickeners and disc thickeners is achieved by a suction leg. Such a thickener differs from the gravity deckers in that a pulp layer is formed for them. This means that subsequent to thickening the consistency of pulp is 8 to 14%. The capacity of a vacuum or disc thickener is about the same as that of a gravity decker The difference is that the pulp web is formed by suction on the filtering surface by the pulp suspension when said surface is underwater. From the web formed on the part of the drum when such has risen above the surface of the suspension, filtrate is removed so as to achieve the consistency of said 8 to 14% in the discharge. It is clear that when forming a fiber mat on the filtering surface, the discharge of liquid through the layer substantially slows down due to the great flow resistance of the filter web.

It is not advantageous to use this type of thickener when tending to prethicken, but they may be applied when the discharge consistency required is high. The specific thickening capacity varies according to the quality of pulp, and conditions 50–300 $l/m^2/min$. Compared to the above example two vacuum filters of said size would be required when aiming for a consistency of 10%. The advantage of a disc filter compared with a vacuum drum filter is that more filtering surface can be included in the same volume.

A pressure filter differs from the vacuum drum filter in that the filtering pressure difference is generated by pressure.

The problem with these and many other types of thickeners is their tendency to clog. As an example, a situation can be mentioned, in which the pressurized suspension to be thickened is led to a thickener, whereby, in principle, the pressure difference is unlimited. In laboratory tests this type of thickener was clogged by sulfate pulp in ten seconds, after which it had to be cleaned.

Several methods are known to prevent the clogging or to loosen the web from the filter. For example, in FI patent specification No. 41712 and U.S. Pat. specification No. 3,455,821 the purpose is to clean the filter surface by vibration. However, the damping ability of the gaseous and fibrous paper pulp prevents the cleaning effect of the vibrations.

One method is shown in FI specification No. 68005, according to which cleaning of the disc filter is carried out by using compressed air. At a certain stage of the disc sector circulation, compressed air is led to the inside of the disc sector, whereby the blast loosens the filtered pulp from outside the sector.

SUMMARY OF THE INVENTION

The object of the present invention is to avoid or minimize the drawbacks of the above-mentioned solutions and to create a new method and apparatus for the continuous thickening of 0.5–20% consistency pulp, without having to remove liquid through a thick fiber mat formatted non-controllably on the filter surface due to pressure difference. The filter plates are theoretically able to remove considerably greater amounts of liquid than in practice, because the pulp thickening on the surface of the filter plate effectively prevents the discharge of greater amounts of liquid Thus, it is possible to increase the filtering capacity considerably, if the formation of a thick fiber mat on the surface of the filter plate can be prevented.

A method and an apparatus for solving said problem by being able to totally fluidize the pulp flow to be thickened is disclosed in a FI patent application No. 781789 (Gullichsen). Said structure comprises a cylindrical conduit having a perforated wall disposed around a centrally located rotor. The rotor fluidizes the suspension, whereby the fibers of the suspension are separated in the suspension and water can be filtered through the filter surface. As the suspension is totally fluidized, a fiber mat is not able to form on the filter surface and to plug the openings of the filter surface.

However, a huge amount of energy is needed to fluidize the pulp flowing through the conduit for the time needed to separate the liquid The amount of energy needed when using the apparatus described in said FI patent application can be compared to the energy needed when using the apparatus in accordance with the present invention as follows. Let us assume a case where pulp of a consistency of 10% is dewatered to a consistency of 20%. Gullichsen has to fluidize all the suspension inside the filtering chamber, whereby the energy needed is $E_{20}$ kW /mass ton and the rotational speed of the rotor is $n_{20}$ rpm. $E_{20}$ is the energy needed to fluidize pulp at a consistency of 20%. $n_{20}$ is the rotational speed of the rotor necessary to create shear stresses high enough to fluidize the pulp at a consistency of 20%.

However we have found out that is not necessary to fluidize the total mass flow to be able to remove liquid from the suspension as efficiently as Gullichsen It only has to be ensured that a thick fiber mat may not be formed on the filtering surfaces and that the changes in consistency measured as a function of distance from the filtering surface are minimized Based on the principles above, dewatering of pulp in accordance with our invention is operationally divided into two basic stages:

Mixing of the pulp in the mixing zone; and

Controlling the thickness of the fiber mat on the filter surface and loosening and removing the extra fiber mat from said surface in the thickening zone.

Firstly, the energy needed for mixing the pulp in the filtering chamber for achieving a uniform pulp in relation to the inlet consistency is $E_m=0.03 \ldots 0.15 * E_{20}$ and the rotational speed of the rotor is $n=0.4 \ldots 0.7 * n_{20}$. Secondly, the energy used for controlling loosening and removing the fiber mat from the filter surface is $E_1=0.5 \ldots 0.8 * E_{20}$. It is also to be noted that the energy mentioned above is subjected to the filter surface not to the whole filter chamber Finally, the average energy used in our invention is $E=0.15 \ldots 0.5 * E_{20}$.

Another severe problem with the Gullichsen method and apparatus is that while the suspension is completely fluidized the fibers move separately and tend to be screened through the filter openings with the filtrate.

The method and the apparatus in accordance with the present invention is able to overcome this problem, too, as it is possible to let a fiber mat of a certain thickness form on the filter surface whereby the mat acts like a filter cloth letting the liquid pass through, but preventing the fibers from getting to the openings By measuring the pressure difference across the filter surface, one is able to control the formation of a fiber mat and control the dewatering operation in total.

In addition, the present invention solves yet another problem. As already earlier stated the consistency of the pulp in the filtering chamber tends to increase towards the filtering surface and the present invention is able to prevent this by continuously mixing the pulp. However, the consistency of the pulp also increases towards the discharge end of the filtering apparatus in the case where the flow of the pulp to be thickened is axial. This phenomenon creates difficulties in controlling the operation of the filtering apparatus, at one end of the apparatus the fiber mat is forming on the filtering surface at a certain pressure, while at the other end of the apparatus more pressure could used for removing liquid through the filtering surface.

The purpose of the invention is to create an apparatus, in which the pulp to be thickened is introduced as a continuous flow onto the filter surface, which pulp does not permanently attach to the filter surface, but flows along the surface towards the discharge opening in such a way that no thick, unbroken, non-controlled fiber mat is generated, and the pulp thickens continuously. This desired operation may be facilitated by using known filter drums, the diameter of the perforations or the width of the slots of which is even less than 0,3 mm, whereby the fibers of the pulp do not pass the perforated plate. Significant to the apparatuses applying this variation of the method according to the invention is the requirement that the size of the pores, slots or perforations be sufficiently small. It has been noted in the tests that for most wood fibers the perforation size of 0,2–0.3 mm is sufficiently small. When such a small perforation size is used liquid can be removed, and yet the filtrate does not have disturbingly many fibers. In one performed test in which the consistency of the pulp was raised from 10% to 15% the fiber consistency of the filtrate was less than 0,1%. If the perforation size is, for example, 0,5 mm, it is necessary to let a thin fiber mat layer form on the filter surfaces, which thus prevents the penetration of the fibers to the filtrate.

Another way to dewater a suspension is to let the pulp flow along the surface covered by a thin fiber mat.

The thickness of the mat is controlled, especially when the diameter of the perforation is more than 0,3 mm, by forming a thin fiber mat on the plate to prevent the flow of moving fibers through the perforations of the filter surface This is the way to operate, when the openings of the filtrate surfaces are considerably large and a thin fiber mat layer operates as the actual filter surface.

A further significant feature of the invention resides in that pulp is mixed in the thickening chamber by a moving member so as to continuously equalize its consistency so that even close to the filter surfaces the consistency does not much differ from the average consistency. Both in the amount of increase in the consistency and in the uniformity of the consistency value of the thickened pulp the results of the method of the present invention overwhelmingly outnumber the previous methods.

The method according to the invention utilizes a blade or similar arrangement arranged in communication with the filter cylinder movable relative to the filter cylinder on the side of the pulp to be thickened. The blade arrangement does not, however, mechanically wipe the surface of the filter cylinder, but only causes the fiber mat thickened on the filter surface to be peeled off the surface. The blade arrangement also creates suction from the perforations towards the inside on the discharge side, whereby the fibers, possibly stuck on the surface of the perforations and the filter cylinder, loosen. Another purpose of the blades is to keep the pulp layer movable. Thus, the method according to the invention is characterized in that the suspension to be thickened is fed into a filtering chamber, the suspension is formed into a layer that is continuously being mixed for equalizing the consistency differences, the liquid is continuously removed from the suspension and the thickness of the fiber mat being formed on the filter surface is controlled by subjecting said mat to shear stresses.

A further characterizing feature of the invention is that the suspension to be thickened is formed into an annular layer and is operationally divided into two basic zones. The outer zone with respect to the filtering surface is a mixing zone which is being continuously mixed for equalizing the consistency differences in said zone. The closer/inner zone with respect to the filtering surface is a thickening zone which is subjected to shear stresses by both the friction between said zones and the movement of a mixing member for controlling the thickness of the fiber mat forming on the filter surface, whereby the liquid is removed from the thickening zone.

One variation of the method according to the invention is characterized in that the suspension to be thickened is introduced into the thickening apparatus in pressurized state and a substantially thin layer of pulp is brought into communication with the filtering surface, said layer being mixed continuously in a way such that the consistency of the suspension is maintained substantially constant throughout the layer. The fiber mat is prevented from non-controllably forming on the filtering surface, and the thickness of the fiber mat is controlled by regulating the pressure difference across the filtering surface.

A preferred feature of the method according to the invention is characterized in that the pulp to be thickened is introduced into the filtering chamber substantially along the full axial length of said chamber. The suspension is made to rotate in the chamber, the liquid being removed from the suspension and the suspension being discharged from said filtering chamber substantially along the full length of said chamber. Thereby the consistency of the suspension is maintained uniform throughout the filtering chamber.

The apparatus for thickening fiber suspensions in accordance with the invention is characterized in that at least one of the co-operating surfaces, preferably the filtering surface and its counter surface, is provided with means for non-mechanically limiting the thickness of a fiber mat on the filtering surface, whereby uncontrolled formation of a fiber mat on the filtering surface is prevented.

A preferred embodiment of the apparatus in accordance with the invention is characterized in that it comprises a substantially cylindrical member disposed inside the apparatus and has a substantially axial slot, through which the suspension to be thickened flows between said member and the filtering surface.

Another preferred embodiment of the apparatus in accordance with the invention is characterized in that the housing of the apparatus comprises a conduit for gas to be fed into the apparatus for backflushing the openings of the filtering surface and for creating a gas bubble in the middle of the apparatus for controlling the total thickness of the pulp layer to be thickened.

The advantages achieved with the invention are, among others. An acceleration of the thickening operation and an increase of the ability to discharge liquid in the thickener, because no thick fiber mat layer is allowed to generate from the pulp to be thickened, which surface layer would prevent the liquid from flowing from the middle of the pulp stream to the filter surface. Other advantages of the closed arrangement to be mentioned are, for example, inconvenient odors are not generated in the thickening and that the apparatus may be pressurized or partially vacuumized.

A still further and important advantage over some prior art methods and apparatus is the considerably lower energy consumption.

BRIEF DESCRIPTION OF THE DRAWINGS

The invention is described below in detail with reference to the enclosed drawings, in which.

DETAILED DESCRIPTION OF THE PREFERRED EMBODIMENTS

Figure 1:
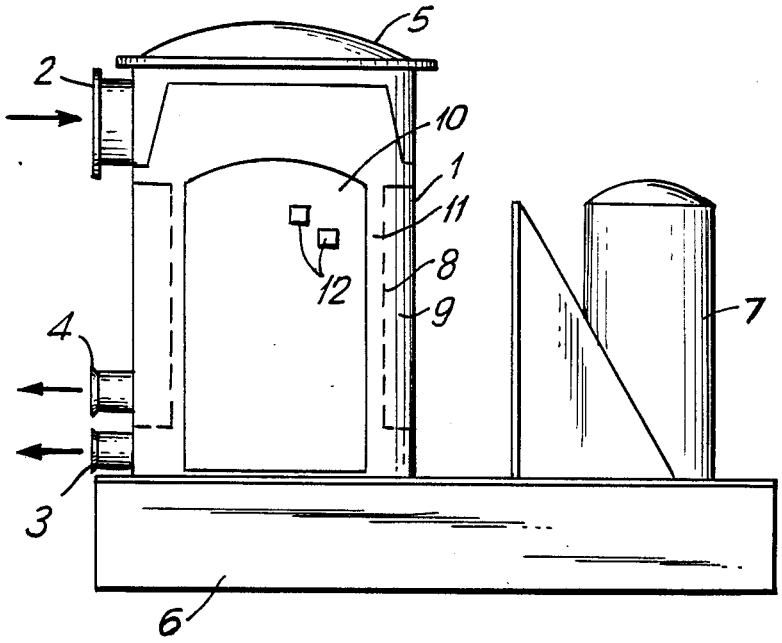
FIGS. 1 nd 2 are schematic elevational illustrations of a first and a second embodiment of an apparatus for carrying out the method according to the present invention.

In FIG. 1 there is illustrated an embodiment of a pulp thickening apparatus in accordance with the invention comprising a cylindrical outer casing 1 with an inlet connection 2 for the pulp to be thickened, an outlet connection 3 for the thickened pulp and an outlet connection 4 for the filtrate, a top cover 5 and a frame structure 6 including a base plate and a drive means 7. Inside the casing 1 there is a drum 8 for operating as a filter surface leaving an annular space 9 for the filtrate therebetween. Inside the drum 8 there is a rotor 10 arranged to rotate near the filter surface 8. By arranging the form of the rotor 10 such that it accelerates the pulp to a sufficient circumferential speed, it is possible to carry out a sufficiently efficient mixing of pulp with this arrangement. An alternative is to arrange the thickening drum as a rotor, whereby the purpose of the counter part, the stator, is to act to keep the pulp stationary or let it flow axially downwards between the rotating drum and the stator. On the surface of the rotor 10 there are members 12 for loosening fibrous layer. It is also possible to attach equipment to the apparatus for discharging light impurities, such as plastics or like.

The pulp to be thickened is introduced into the apparatus via inlet connection 2 wherefrom the pulp flows on the rotor 10 and further into the ring-shaped thickening chamber 11 between the rotor and the filtering surface 8 The rotor, and especially its members 12, tends to rotate the pulp so that a fiber mat is not able to freely form on the filter surface. Due to the rotation of the rotor, the pulp being thickened is continuously being mixed so that the consistency is increased uniformly throughout the pulp layer in said filtering chamber. It is clear, however, that the consistency of the pulp in the filtering chamber is increased when passing downwards in said chamber. The liquid being filtered through the openings of the filtering surface is discharged via outlet connection 4 from the filtrate chamber 9 and the thickened pulp via outlet connection 3 from the lower part of the apparatus.

Figure 2:
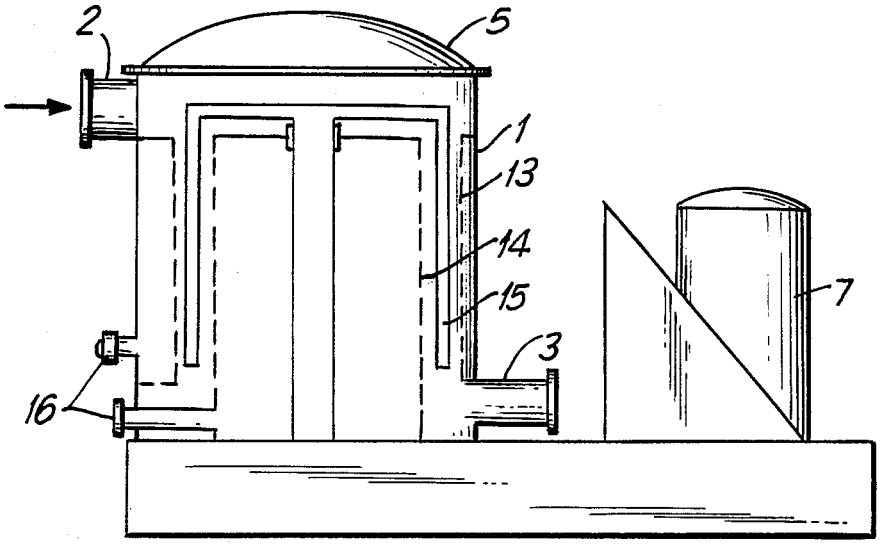

Another embodiment is illustrated in FIG. 2, and includes a thickening apparatus, which is mainly composed of the same components as the apparatus in accordance with FIG. 1. The only difference is that the apparatus of FIG. 2 has two filter surfaces/drums 13 and 14 between which a rotatable rotor 15 is arranged The operation of the apparatus is quite the same as in FIG. 1 with the exception that the filtrate is discharged via two outlet connections 16.

Figure 3:
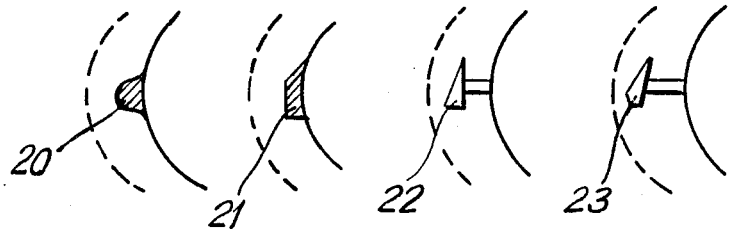
FIG. 3 illustrates four embodiments of the recesses of the rotor surface.

FIG. 3 illustrates different types of members (12) for mixing the suspension and for controlling the thickness of the fiber mat on the filter surface, which filter surface, i.e. the fiber mat, is subjected to reciprocating/alternating pressure/suction pulses, which loosen fibers stuck on the openings of the filter surface or fibers which have partly penetrated the openings and due to which the flow of the filtrate through the filter surface is facilitated. The pulsating member 20 is a hemispherical protrusion arranged on the surface of the rotor or on the blade of the rotor. A bulge member 21 is illustrated with the upstream edge thereof being steep and the downstream edge inclined A member 22 is a variation of member 21 and is a rib which extends close to the surface of filter plate, the upstream edge of which is steep and the downstream edge inclined throughout the rib. A member 23 is illustrated as a variation of member 22 wherein the rib is designed to consume as little power as possible, in other words it is formed aeroform-like.

It is also advantageous to group the rotor and the pulsating members in the rotor and design them in such a way that the inflowing pulp is distributed equally all through the thickening zone.

Figure 4:
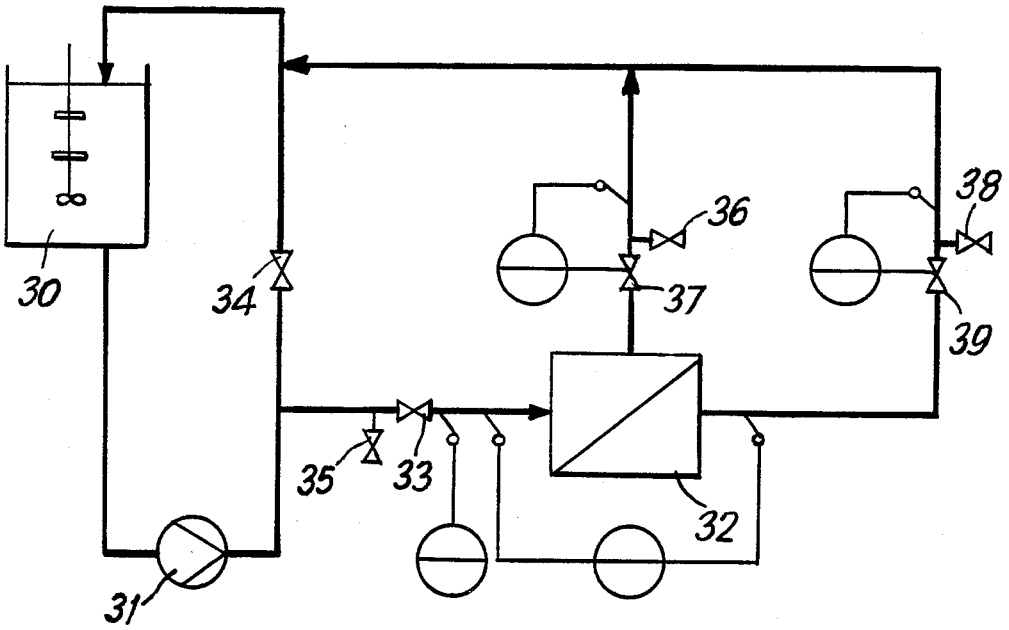
FIG. 4 is a diagram of an arrangement of test equipment used when testing the method and the apparatus in accordance with the invention.

The method and apparatus in accordance with the invention have been examined in the laboratory by tests according to FIG. 4. The reference number 30 signifies a circulation tower, from which pulp is pumped by a feed pump 31 to the test, i.e. filter, apparatus 32 through a feed valve 33. The pulp may be, if required, led back to the circulation tower 30 directly past the filter apparatus 32 with valve 34. A sample of unthickened pulp was taken from the extracting member 35 and a sample of thickened pulp from a connection 36 after the valve 37. A sample of the filtrate was taken from the member 38 downstream of filter valve 39. It is possible to adjust the desired pressure condition in the filter apparatus 32 by valves 37 and 39. The dimensions of the filter apparatus in the test were:

| | |
|---|---|
| Surface area of the filter cylinder in the testing apparatus | 0.4 $m^2$ |
| Size of perforation in the filter cylinder of the testing apparatus | 0.2 mm |
| Pulsating members of the rotor in the testing apparatus according to FIG. 3 | |

| Results | pine sulfate | birch sulfate |
|---|---|---|
| inlet consistency in the apparatus | 0.5% | 0.5% |
| consistency of thickened pulp | 1.5% | 1.5% |
| consistency of filtrate | 0.02% | 0.04% |
| capacity to discharge liquid | 4500–5500 l/m2/min | |
| pressure difference in the test run | 20–40 kPa | |

The tests performed show that it is possible to reach multiple efficiency with the pressurized thickening method and apparatus compared with the conventional thickeners. Additionally, the apparatus is compact in construction Due to the pressurized operational principle, both the filtrate and the thickened pulp are overpressurized, thus there is a great liberty and possibility to save space in positioning the apparatus to suit the mill conditions. Additionally, inflow of air into the pulp in the thickening is impossible.

Figure 5:
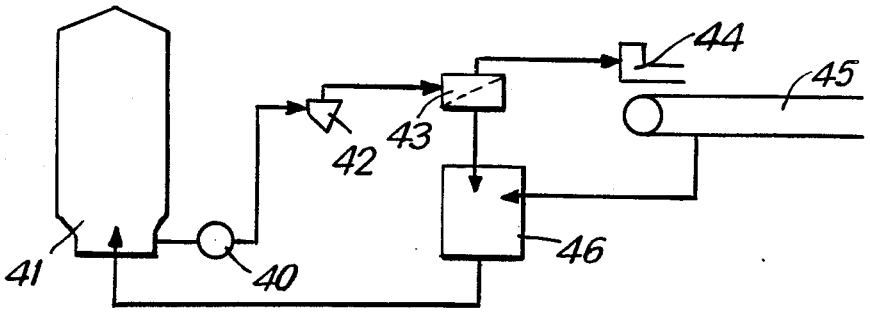
FIGS. 5 and 6 are diagrams illustrating processes utilizing the method and apparatus in accordance with the invention.
Figure 6:
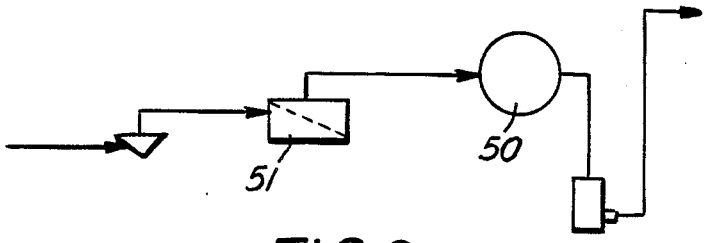
Figure 7:
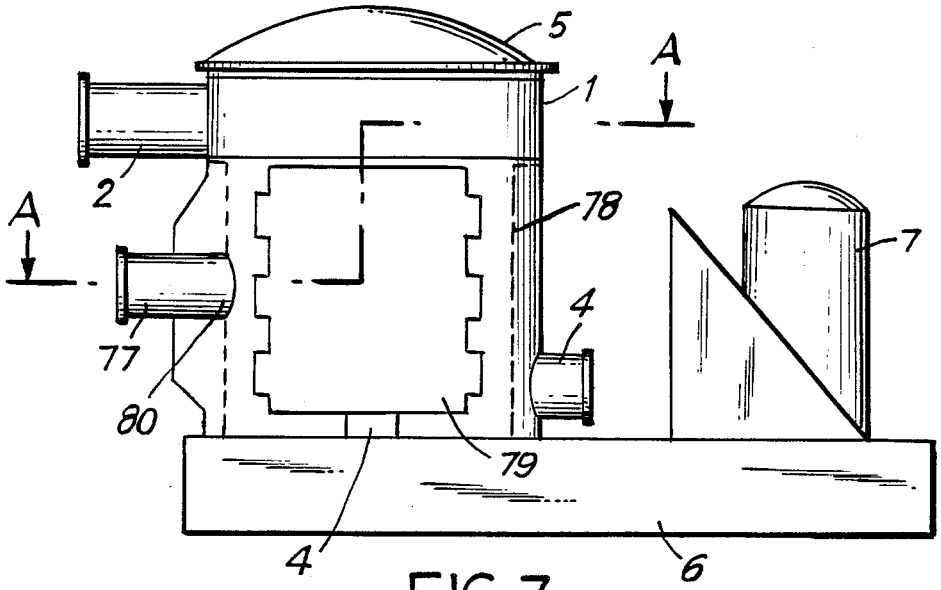
FIGS. 7 and 8 are an elevational and plan view, respectively, of a third embodiment of an apparatus in accordance with the invention.

The apparatus used in tests according to FIGS. 5 and 6 is in principle similar to that of FIG. 7, in other words it comprises a housing 1, a cover 5, a base 6, and drive means 7. The housing has an inlet conduit 2 for the pulp, a discharge conduit 4 for the filtrate and a discharge conduit 77 for the thickened pulp. In addition, a discharge conduit for the possible reject may be arranged to the housing. Inside the housing is arranged a stationary filter surface 78 and relative to it a movable surface 79, which may be, for example, a rotatable rotor 79, which may be of any type such as shown in FIG. 3 or of any other suitable type.

Figure 8:
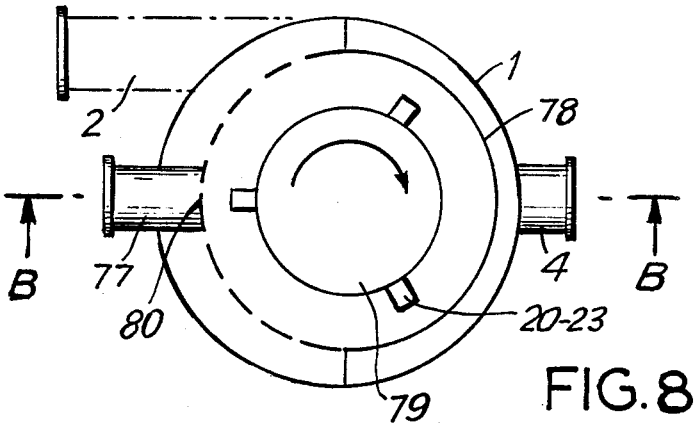

The embodiment of FIGS. 7 and 8 differs from the previous arrangements in that the filter surface is not a uniform cylinder, but it has a discharge opening 80, which is in communication with the discharge conduit 77, which is not located in the lower part of the thickener as in the apparatus according to FIGS. 1 and 2, but is located on the side of the thickening apparatus.

In FIG. 5 the pulp is introduced by a pump 40 from the mass tower 41 through the cyclone separators 42 to the filtering apparatus 43, wherefrom the thickened suspension is further transferred to the headbox 44 of a paper making machine or a filtering press. The liquid containing a small amount of fibers and being filtered through the wire 45 of the paper machine is returned to the wire pit 46, whereto the filtrate from the filtering apparatus 43 is also introduced. The very dilute suspension may be fed from the wire pit 46 to the mass tower for diluting the suspension to meet the consistency demands of the cyclones 42. Thus it is possible to feed thick pulp to the mass tower 41 to be diluted by the filtrates of the thickening apparatus and the paper machine, whereby the fibers being carried along the filtrates are returned back to circulation. It is clear how great an advantage can be gained by closed and pressurized filtering of this type.

In FIG. 6 there is shown an embodiment, where the feed of the filtering apparatus 50 is prethickened at a pressurized stage by a dewatering apparatus 51 instead of a conventional method. By using this method, the air is prevented from getting into the process, too.

Advantages achieved by said arrangement are, for example the following: the opening 80 of the filter surface 78, regardless of whether it is an opening as high as the whole filter surface or lower, generates additional turbulence, which cleans the filter surface and the rotor. On the other hand, the thickened pulp does not have to flow between the rotor and the filter surface all through the apparatus down to the bottom part, but the thickened pulp is discharged at an earlier stage. It is also to be noted that the mutual position and operation of the filter surface and the rotor does not necessarily have to be as described above, but it is quite possible that the stationary, not quite uniform cylindrical part is a member arranged with the surface alternative according to FIG. 3 and that the rotational part is a filter surface, whereby the filtrate is discharged through the rotational member. The apparatus above arranged vertically may also be arranged horizontally or, if desired, into an inclined position.

Figure 9:
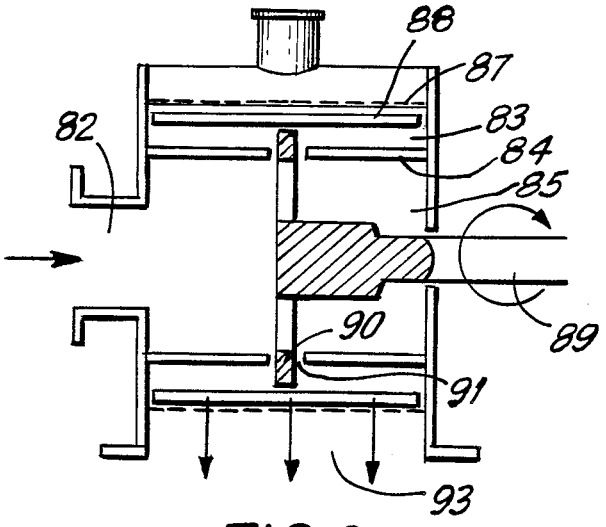
FIGS. 9 and 10 are an elevational and plan view, respectively, of a fourth embodiment of an apparatus in accordance with the invention.
Figure 10:
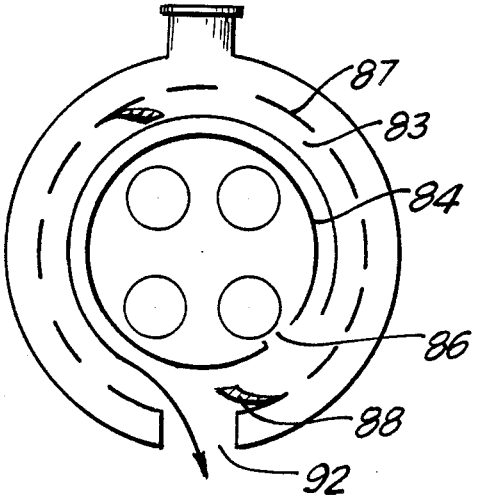

A further development of the version of the apparatus according to FIGS. 7 and 8 is shown in FIGS. 9 and 10, in which pulp is brought axially into the apparatus via a conduit 82. A filtering chamber 83 is separated by a stationary cylinder 84 from the middle part 85 of the apparatus, from which the pulp may flow off only through one substantially axial slot 86 in the cylindrical inner wall 84 of the chamber 83 into the chamber 83 between said cylindrical surface 84 and filter surface 87. Into the chamber 83 there is arranged a rotatable rotor/blade member 88, the purpose of which member is to keep the pulp in motion, mix it and control the thickness of the fiber mat on the filter surface 87. The rotor/-blade member 88 is preferably mounted on the shaft 89 by means of an arm 90 arranged substantially in the middle part of the apparatus and extending through the slot 91 in the cylindrical wall 84. Pulp is discharged from the apparatus shown in FIG. 7 according to the method. In other words, by arranging an opening 92 of the same height as the apparatus on the filter surface 87 through which the pulp can flow off into the discharge conduit 93. The filtrate is discharged from the apparatus to the opposite direction when compared to the thickened suspension. By arranging a throttle means in the discharge conduit 93 it is possible to control the time the pulp circulates in total in the apparatus before flowing into the discharge conduit 93. Said openings of the cylinder 86 and the filter surface 92 are preferably located relative to each other so that the blade member 88 commencing the circulation of the pulp flowing in from the opening 86 of the cylinder comes from the direction of the opening 92 of the filter surface, thereby the pulp is to circulate at least almost a whole round before the first possibility to flow off from the apparatus.

An advantage compared with the arrangements in FIGS. 1 and 2 according to the tests resides in the fact that the operation of the apparatuses in accordance with FIGS. 7, 8, 9 and 10 is easy to adjust The pressure above the filter surface remains the same along the height-/length of the filter surface and does not vary, as in some arrangements of the prior art technique.

Figure 11:
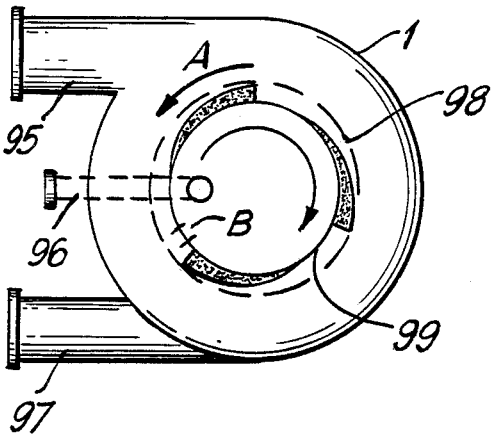
FIG. 11 is a plan view of a fifth embodiment of the apparatus in accordance with the invention.

The apparatus shown in FIG. 11 is very much like the apparatus in FIG. 1. The apparatus is shown viewed from above and comprises a housing 1, conduits 95, 96 and 97 for the inlet of the pulp to be dewatered, for the discharge of the filtrate and for the thickened pulp, respectively; a filter surface 98 and a rotor 99 also being provided inside the filter surface The pulp is fed into the chamber outwardly of the filter surface 98, i.e. between the housing and the filter surface 98, whereby the discharge of the filtrate is discharged in the opposite direction compared to the other embodiments, in other words the filtrate flows inwardly through the filter surface 98. In this embodiment it is sometimes advantageous to arrange for the filter surface 98 to be rotatable, as shown by the arrow A and for the surface 99 inside it to be stationary, whereby said stationary surface 99 subjects pulses to the filter surface 98 for removing filtrate through the filter surface 98 and for loosening or removing fiber mat. One preferred embodiment of the surface to be noted is an arrangement in which recesses, shown in FIG. 11 as spaces between the black ridges, are made on the stationary surface, and which generate suction through the filter surface 98. The recesses may end either to the part ascending to the same level with the rest of the surface, whereby they bring about a pulse, the direction of which is opposite to the filter surface 98, which pulse loosens the fiber mat form on the filter surface 98, or the recesses may also end to the opening B through which the liquid filtered through the filter surface 98 may be discharged to the inside of the surface, from where it is further discharged from the apparatus The advantages of the apparatus according to this embodiment worth mentioning are, for example, firstly the fact that it is possible to create an intensive suction effect on the surface inside the filter surface, whereby the thickening effect is very efficient. Secondly, when operating as a rotor the surface need not cause the whole of the pulp flow flowing into the apparatus to undergo rotational movement, in other words savings in energy are achieved. Thirdly, energy is also saved by designing the surface 98 in such a way that the amount of energy consumed is as little as possible, regardless as to whether the surface operates as a rotor or as a stationary, pulse generating surface. This is the object, for example, in the last described embodiment, in which recesses are made on said surface. In this embodiment the pulse members to be used really differ somewhat from what is shown in FIG. 3, because their most important purpose is to subject the filter surface to a long suction, which is as even as possible and by which filtrate is removed through the filter surface from the pulp. It is, of course, clear that the intensity of the suction effect determines the length of the suction stage. If the suction is very intensive, the pulp tends to thicken quickly on the filter surface, whereby the length of the suction pulse may not be so great that the pressure pulse is not anymore able to loosen the fiber mat on the filter surface. On the other hand, by adjusting the speed difference between the filter surface and the surface generating pulses, it is possible to adjust the desired thickening speed so that the relation of the discharge of the filtrate to the amount of the fiber mat is optimal.

Figure 12:
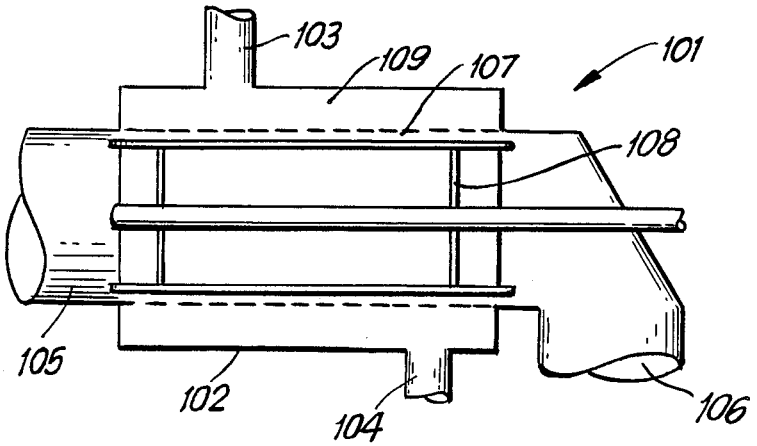
FIG. 12 is an elevational view of a sixth embodiment of the apparatus in accordance with the invention.

A sixth embodiment is shown in FIG. 12 and is quite different from those studied earlier in this specification.

The apparatus 101 of FIG. 12 is intended to be used most advantageously in a horizontal position. It comprises a cylindrical housing 102 having two conduits 103 and 104 for the gas and for the filtrate, respectively. The conduit 105 for the inlet of pulp to be thickened is arranged at another end of the apparatus and a discharge conduit 106 for the dewatered pulp at the opposite end of the apparatus. In one version a filtering drum 107 arranged axially inside the housing 102 is stationary and a rotor 108 is arranged inside the drum, which rotor maintains the motion in the pulp. In the present arrangement air or other gas is fed behind the filter surface 107 from conduit 103. The filtering drum is surrounded by a chamber 109 for the feed of air. Air may be fed either as a pulsating or continuous flow, most important is that air replaces the water which is radially removed from pulp layer and discharged via conduit 104 from the apparatus. The thickened pulp is led out of the apparatus from the opposite end relative to the feed end in the same pressure as the infed pulp. The pressure difference prevailing between the filtrate and the infed pulp is 20–100 kPa depending on the case.

Another version is the arrangement, in which the thickening drum rotates and on any sector of the drum said compressed air blow is arranged The blow may be continuous, which ensures that the filter surface remains clean.

The flow of air into the thickener may in some cases be utilized in such a way that an air bubble is allsured to grow in the center of the thickening apparatus so that the bubble controls the thickness of the fibrous layer moving close to the filtrate surface. In this case the rotor generates a sufficient shear force field in the pulp layer to mix the pulp and to make a successful thickening. When required, in other words when it concerns a pressurized thickener, it is possible to replace the air bubble with a central member between which member and filter surface the rotor rotates.

It is to be noted that when utilizing the gas bubble inside the filtering surface the rotor may be formed of several foil-type blades as the gas bubble controls the thickness of the pulp layer to be thickened and the blades only mix the pulp and control the thickness of the pulp mat on the filter surface.

An essential or important feature to all of the above described arrangements is the fact that a relatively thin pulp layer is somehow arranged close to the filter surface. At the same time it is ensured that the entire amount of pulp flowing into the apparatus comes into contact with the filter surface and that the consistency of the pulp inside the filtering chamber is being maintained uniform regardless the distance from the filter surface.

Test runs have shown that the higher the consistency is, the larger an opening of the filter plate may be used. This is due to the fact that the fiber network is at that moment stronger and a single fiber is not loosened so easily from it. This enables the use of filter plates with openings of one or more size/sizes. It is a known fact that a larger opening gives a greater penetration and the production of the apparatus is less expensive. The most practicable arrangement is carried out, for example, whereby in the inlet end the perforations are smallest, in the middle slightly larger and in the discharge of the thickened pulp the perforations are at their largest.

As it may be noted from the above description, a new type of pulp thickening method and apparatus for carrying out such has been developed, with which it is possible to eliminate or minimize the drawbacks of the apparatuses of the prior art technique without creating new problems. It is clear that only a few advantageous apparatus alternatives and points of application have been introduced above, which by no means are intended to restrict the invention from what is defined in the enclosed claims. Thus it is clear that both the filter surface and the surface movable relative to the filter surface may be of a form different from cylindrical, said members are only characterized in that they are substantially rotationally symmetrical, cylindrical, conical or spherical, or their form is a combination of those, just to mention a few examples.

We claim:

1. A method of thickening fiber suspensions by removing liquid therefrom, comprising the steps of: introducing the fiber suspension to be thickened into a filtering apparatus provided with at least one filtering surface; causing the suspension to move in relation to at least one filtering surface; removing liquid from said suspension through said filtering surface; preventing the fibers of said suspension from passing through said filtering surface; and separately discharging both the thickened suspension and the filtrate from the apparatus, the fiber introducing step including feeding the suspension to be thickened into a filtering chamber at a pressurized state, the suspension forming into a layer that is continuously being mixed to equalize any consistency differences, but is not completely fluidized; said liquid removing step including continuously removing liquid from the suspension, and said preventing step including non-mechanically limiting the thickness of a fiber mat forming on the filter surface by providing a rotor to subject the mat to shear stresses.

2. A method in accordance with claim 1, further comprising the step of subjecting the filtering surface to alternating positive and negative pulses by members on the rotor so that fibers in the openings of the filtering surface are loosened and the filtrate is permitted to flow through said surface so that an uncontrolled random formation of a fiber mat on the filtering surface is prevented and discharge of liquid from the suspension is effected.

3. A method in accordance with claim 1, and further comprising the step of forming the suspension to be thickened into a layer, which is operationally divided into two basic zones, including an outer zone with respect to the filtering surface which is continuously mixed for equalizing consistency differences in said zone, and a closer/inner zone with respect to the filtering surface which is subjected to shear forces by both friction between said zones and movement of said rotor for non-mechanically limiting the thickness of the fiber mat forming on the filter surface so that liquid is removed from the thickening zone.

4. A method of thickening fiber suspensions, comprising the steps of:

introducing fiber suspension into a filtering apparatus provided with at least one filtering surface;

feeding the suspension to be thickened at a pressurized state into a filtering chamber so that a substantially thin layer of pulp is brought into communication with the filtering surface;

causing the suspension to execute rotational movement in relation to at least one filtering surface;

removing liquid substantially free of fibers from the suspension to thicken it, said layer being continuously mixed so that the suspension has a consistency which is maintained substantially constant throughout the layer but is not completely fluidized;

regulating a pressure difference across the filtering surface so as to prevent a fiber mat from forming in a random uncontrolled manner on the filtering surface and to non-mechanically limit the thickness of the fiber mat; and separately discharging the thickened suspension and the filtrate from the apparatus.

5. A method in accordance with claim 1 or 4 wherein the fiber suspension is thickened from a consistency of 0.3–1.0% to a consistency of 1.0–5.0%.

6. A method in accordance with claim 1 or 4, wherein the fiber suspension is thickened from a consistency of 3–10% to a consistency of 10–25%.

7. A method in accordance with claim 1 or 4, wherein the specific energy used for thickening the suspension is 15 to 50% of the energy required for complete fluidization of said suspension.

8. A method in accordance with claim 1 or 4, wherein the specific energy used for mixing the suspension in the thickening zone is 3 to 15% of the energy required for complete fluidization of said suspension.

9. A method in accordance with claim 1 or 4, wherein the specific energy used for controlling the thickness of the fiber mat on the filtering surface is 50 to 80% of the energy required for complete fluidization of said suspension.

10. A method of thickening fiber suspensions by removing liquid therefrom, comprising the steps of:

introducing the fiber suspension to be thickened into a filtering apparatus provided with at least one filtering surface;

causing the suspension to move in relation to the at least one filtering surface;

removing liquid from said suspension through said filtering surface;

preventing the fibers of said suspension from passing through said filtering surface; and separately discharging both the thickened suspension and the filtrate from the apparatus, the fiber introducing step including feeding the suspension to be thickened into a filtering chamber at a pressurized state along the full axial length thereof, the suspension forming into a layer that is continuously rotated in the chamber to equalize any consistency differences, said liquid removing step including continuously removing liquid from the suspension, said preventing step including controlling the thickness of a fiber mat forming on the filter surface by providing a rotor to subject the mat to shear stresses, and said discharging step including discharging the suspension from the filter chamber substantially along the full length of said chamber so that the consistency of the suspension is maintained uniform throughout the filtering chamber.

11. A method of thickening fiber suspensions, comprising the steps of:

introducing fiber suspension into a filtering apparatus provided with at least one filtering surface;

feeding the suspension to be thickened at a pressurized state into a filtering chamber along the full axial length of said chamber so that a substantially thin layer of pulp is brought into communication with the filtering surface;

causing the suspension to execute rotational movement in relation to at least one filtering surface;

removing liquid from the suspension to thicken it, said layer being continuously mixed so that the suspension has a consistency which is maintained substantially constant throughout the layer;

regulating a pressure difference across the filtering surface so as to prevent a fiber mat from forming in a random uncontrolled manner on the filtering surface and to control the thickness of the fiber mat; and separately discharging the thickened suspension and the filtrate from the apparatus, including discharging the suspension from the filtering chamber substantially along the full length of said chamber so that the consistency of the suspension is maintained uniform throughout the filtering chamber.

12. A method of thickening fiber suspensions by removing liquid therefrom, comprising the steps of:

introducing the fiber suspension to be thickened into a filtering apparatus provided with at least one filtering surface;

causing the suspension to move in relation to said at least one filtering surface;

removing liquid from said suspension through said filtering surface;

preventing the fibers of said suspension from passing through said filtering surface; and separately discharging both the thickened suspension and the filtrate from the apparatus, the fiber introducing step including feeding the suspension to be thickened into a filtering chamber at a pressurized state, the suspension forming into a layer that is continuously being mixed to equalize any consistency differences, said liquid removing step including continuously removing liquid from the suspension, and said preventing step including controlling the thickness of a fiber mat forming on the filter surface by providing a rotor to subject the mat to sheer stresses, and further including forming a layer inside the filtering surface by arranging a gas bubble in the middle of the apparatus for forcing the suspension to flow along the filtering surfaces.

13. A method of thickening fiber suspensions, comprising the steps of:

introducing fiber suspension into a filtering apparatus provided with at least one filtering surface;

feeding the suspension to be thickened at a pressurized state into a filtering chamber so that a substantially thin layer of pulp is brought into communication with the filtering surface;

causing the suspension to execute rotational movement in relation to at least one filtering surface;

removing liquid from the suspension to thicken it, said layer being continuously mixed so that the suspension has a consistency which is maintained substantially constant throughout the layer;

regulating a pressure difference across the filtering surface so as to prevent a fiber mat from forming in a random uncontrolled manner on the filtering surface and to control the thickness of the fiber mat; and separately discharging the thickened suspension and the filtrate from the apparatus, said layer being formed inside the filtering surface by arranging a gas bubble in the middle of the apparatus for forcing the suspension to flow along the filtering surfaces.

14. An apparatus for thickening fiber suspensions by removing liquid therefrom, comprising:

a housing;

a cover;

an inlet conduit for the suspension to be thickened;

a discharge conduit for the thickened suspension;

a discharge conduit for the removed liquid;

at least one stationary member and a rotary member provided so as to cooperate together, one of said stationary member and rotary member being a filtering surface through which the liquid is removable and fibers are prevented from passing;

drive means for said rotary member; and limiting means provided for at least one of the cooperating surfaces, the filtering surface and its counter surface, for non-mechanically limiting the thickness of the fiber mat on the filtering surface so as to prevent an uncontrolled random formation of a fiber mat on the filtering surface, said filtering surface having an opening through which the thickened suspension is discharged from the apparatus, said opening having a length substantially equal to the axial length of the filtering surface.

15. An apparatus for thickening fiber suspensions by removing liquid therefrom, comprising:

a housing;

a cover;

an inlet conduit for the suspension to be thickened;

a discharge conduit for the thickened suspension;

a discharge conduit for the removed liquid;

at least one stationary member and a rotary member provided so as to cooperate together, one of said stationary member and rotary member being a filtering surface through which the liquid is removable and fibers are prevented from passing;

drive means for said rotary member;

limiting means provided for at least one of the cooperating surfaces, the filtering surface and its counter surface, for non-mechanically limiting the thickness of the fiber mat on the filter surface, so as to prevent an uncontrolled random formation of a fiber mat on the filtering surface; and a substantially cylindrical member disposed inside the apparatus and having a substantially axial slot through which the suspension to be thickened flows between said member and the filtering surface.

16. An apparatus in accordance with claim 15, wherein a rotary member is arranged in the space between said member and said filtering surface.

17. An apparatus for thickening fiber suspensions by removing liquid therefrom, comprising:

a housing;

a cover;

an inlet conduit for the suspension to be thickened;

a discharge conduit for the thickened suspension;

a discharge conduit for the removed liquid;

at least one stationary member and a rotary member provided so as to cooperate together, one of said stationary member and rotary member being a filtering surface through which the liquid is removable and fibers are prevented from passing;

drive means for said rotary member; and limiting means provided for at least one of the cooperating surfaces, the filtering surface and its counter surface, for non-mechanically limiting the thickness of the fiber mat on the filtering surface, as to prevent an uncontrolled random formation of a fiber mat on the filtering surface, the housing of the apparatus being substantially horizontal and including a gas conduit means arranged so as to open into a chamber surrounding the filtering surface so that gas is feedable into the apparatus for backflushing the openings of the filtering surface and for creating a gas bubble in a middle portion of the apparatus for controlling the total thickness of the pulp layer to be thickened said inlet conduit and said discharge conduit for the thickened suspension being connected to said middle portion and said discharge conduit for the removal liquid being connected to said chamber.

18. An apparatus in accordance with claim 12, wherein said limiting means includes foil-type blades.

19. An apparatus in accordance with claim 12, wherein said limiting means includes protrusions on the surface of the rotary member.

20. An apparatus in accordance with claim 12, wherein said limiting means are recesses on the surface of the rotary member.

21. An apparatus in accordance with claim 12, wherein said limiting means includes protrusions or recesses on the surface of the stationary member.

22. An apparatus in accordance with claim 12, wherein said filtering surface is provided with an opening, through which the thickened suspension is discharged from the thickening apparatus.

23. An apparatus in accordance with claim 17, wherein the diameter of the openings of the filtering surface is less than 0.5 mm.

24. An apparatus in accordance with claim 23, wherein the diameter of the openings of the filtering surface is less than 0.3 mm.

25. An apparatus in accordance with claim 24, wherein the diameter of the openings of the filtering surface is 0.2 mm or smaller.

* * * * *